US007677323B2

(12) United States Patent
Stratton et al.

(10) Patent No.: US 7,677,323 B2
(45) Date of Patent: Mar. 16, 2010

(54) SYSTEM AND METHOD FOR AUTOMATICALLY ADJUSTING CONTROL GAINS ON AN EARTHMOVING MACHINE

(75) Inventors: Kenneth Lee Stratton, Dunlap, IL (US); Randall Dean Pruitt, Washington, IL (US)

(73) Assignee: Caterpillar Trimble Control Technologies LLC, Dayton, OH (US)

( * ) Notice: Subject to any disclaimer, the term of this patent is extended or adjusted under 35 U.S.C. 154(b) by 937 days.

(21) Appl. No.: 11/374,971

(22) Filed: Mar. 15, 2006

(65) Prior Publication Data

US 2007/0219693 A1 Sep. 20, 2007

(51) Int. Cl.
*A01B 63/12* (2006.01)

(52) U.S. Cl. ..... 172/7

(58) Field of Classification Search ..... 172/2–7, 172/9, 826; 37/348, 444; 701/50, 54; 414/694, 414/699, 708

See application file for complete search history.

(56) References Cited

U.S. PATENT DOCUMENTS

| | | | | |
|---|---|---|---|---|
| 5,525,043 | A * | 6/1996 | Lukich | 417/218 |
| 5,560,431 | A | 10/1996 | Stratton | |
| 5,860,480 | A * | 1/1999 | Jayaraman et al. | 172/2 |
| 5,974,352 | A * | 10/1999 | Shull | 701/50 |
| 5,994,865 | A * | 11/1999 | Phelps et al. | 318/569 |
| 6,385,519 | B2 * | 5/2002 | Rocke | 701/50 |
| 6,609,369 | B2 * | 8/2003 | Koehler et al. | 60/459 |

* cited by examiner

*Primary Examiner*—Robert E Pezzuto
(74) *Attorney, Agent, or Firm*—Finnegan Henderson Farabow Garrett & Dunner LLP

(57) ABSTRACT

System and method for automatically adjusting control gains on an earthmoving machine include a control system for controlling mechanisms that supply power to an earthmoving implement. The gains associated with the force to the implement are automatically adjusted depending on a blade load that may be determined by a calculation of torque attributable to a blade load. The control gains include a proportional gain and a derivative gain that may be used to determine a control effort lift command associated with the control gains for supplying an appropriate gain to the mechanisms that control the implement.

47 Claims, 6 Drawing Sheets

SYSTEM AND METHOD FOR AUTOMATICALLY ADJUSTING CONTROL GAINS ON AN EARTHMOVING MACHINE

TECHNICAL FIELD

The present disclosure relates generally to a control system for an implement on an earthmoving machine and, more particularly, to a control system for automatically adjusting control gains applied to hydraulic mechanisms that direct the movement of the implement.

BACKGROUND

Earthmoving machines (e.g., track type tractors and/or motor graders commercially available from Caterpillar, Inc.) having an implement such as a bulldozer blade, which is used on a worksite in order to alter a landscape of a section of land. The blade may be controlled by an operator of the machine or control system to perform work on the worksite. For example, the operator may move a lever that controls the movement of the implement through hydraulic mechanisms. Specifically, movement of the lever translates into an electrical signal supplied to the hydraulic mechanisms. The electrical signal causes the hydraulic mechanisms to move, thereby transferring pressure within a cylinder of the hydraulic mechanism. Because the hydraulic mechanisms are coupled to the implement, the transfer of pressure within the cylinder causes the blade to move in a manner consistent with the movement of the lever by the operator.

The electrical signals can be modified based on control gain information, which determines the response of the hydraulic mechanism to lever movement. If the control gain parameters correspond to high control gains, the hydraulic mechanism responds rapidly, but with less stability, to move the cylinder to the desired position. If the control gain parameters are associated with low control gains, however, the electrical signal moves the cylinder at a slower rate, but in a more stable fashion (i.e., reduced overshoot and settling time).

Typically, control gains include a proportional control gain ($K_p$) and a derivative control gain ($K_d$), which are calculated by a proportional-plus-derivative controller to generate an electrical signal referred to as a control effect lift command (CELC) signal. In particular, the CELC signal is calculated by the proportional-plus-derivative controller circuit in accordance with the following formula:

$$CELC=K_p*e_{bh}+K_d*d(e_{bh})/dt$$

In the above equation, $K_p$ is the proportional control gain, $e_{bh}$ is an error in the blade height between a target height and an actual height, $K_d$ is the derivative control gain, and $d(e_{bh})/dt$ is an instantaneous rate of change of the error in blade height between a target height and an actual height.

Generally, the control gains ($K_p$ and $K_d$) are manually tuned by an operator depending upon conditions of the worksite. For example, factors such as implement or blade loads, material properties, and machine travel speed determine the level of precision for which the blade is controlled, and thus, the control gains associated with such blade control. Accordingly, for a given combination of such factors, particular control gains are selected. If other factors are present, however, the control gains must be manually changed for a desired hydraulic mechanism response.

The weight of the material in the implement and the forces acting on the implement as a result of the material properties result in variation in the hydraulic control system "damping."

Specifically, if the machine is operated in a material such as loose rock or sand, the control gain will be set to be within a range that will allow stable control of the blade load. If the control gains are set too high, the control system may not be able to accurately control the contents of the blade, thereby causing spillage, unwanted gouges in the worksite, and/or injury to others. Other material properties may require control gains with different values in order to optimize performance of the machine. For example, if the worksite includes a layered material such as shale, excessive force may be necessary to cut through such material. Thus, control gains required for cutting layered materials may be higher than for materials requiring low gain, such as loose rock or sand. Similarly, if the machines are to be operated at high speeds, high control gains are desired compared to operating at low speeds, because the control system may require more control of the contents of the blade. In existing systems, either the range of materials is restricted or manual adjustment is required.

While the manual adjustment of the control gains does allow for some range in working conditions as explained in the factors above, currently, machines are limited to the worksite condition for which the control gains are manually tuned. Accordingly, operators are required to be experienced and skilled in knowing when and what adjustments are needed based upon the factors described above.

U.S. Pat. No. 5,560,431 to Stratton et al. discloses an automatic adjustment of control gains to account for changing ground profiles. The system of Stratton et al. measures certain parameters (as explained below) so that a maximum productivity can be achieved in moving materials from a worksite or altering the geography of a worksite. The system of Stratton et al. detects a true ground speed of an earthmoving machine (e.g., a tractor). The system also senses an angular rate of the machine and senses the position of a lift actuator included with an earthmoving implement (e.g., a tractor blade). In addition, an amount of slip rate is determined, in which the tractor tracks do not adequately engage with the ground as the operator attempts to move the machine. The system also determines a position of the implement as a function of the slip rate value, the angular rate, and the position of the lift actuator, as well as adjusting control gains based on these parameters in order to achieve maximum productivity. Operating the machine to maximize productivity may only concern physical movement of material without regard to the finished appearance of the work surface. Thus, in order to maximize productivity (i.e., set the control gains to a high enough level to ensure that as much material can be moved as possible), the control gains are adjusted based upon many parameters, such as the ground speed, the slip rate, the angular rate, and the position of the lift actuator. However, Stratton et al. does not take into account automatic adjustments of the control gains for "finished dozing," in which operators of the earthmoving machines seek to maintain a level profile of the worksite or a particular appearance of the work surface in accordance with a predetermined plan. Thus, as opposed to maximum productivity, control gains for finished dozing may be lower to ensure a less aggressive response by the proportional-derivative controller. Using Stratton et al. for "finished dozing" operations may not be suitable, because adjusting the control gains for a more aggressive response by the proportional-derivative controller may cause spillage, and unwanted gouges in the worksite.

The disclosed system is directed at overcoming one or more of the shortcomings in the existing technology.

SUMMARY OF THE INVENTION

In accordance with one aspect of the present disclosure, there is provided a method for adjusting a control gain of a work implement on a machine based upon a load associated with the work implement. The method includes determining the load associated with the work implement. The method also includes adjusting the control gain based upon the determined load.

According to another aspect of the present disclosure, there is provided a system for automatically adjusting control gains for controlling an implement. The system includes a load calculator configured to determine a load and a controller being configured to adjust a control gain supplied to the implement based upon the load.

DETAILED DESCRIPTION

Figure 1A:
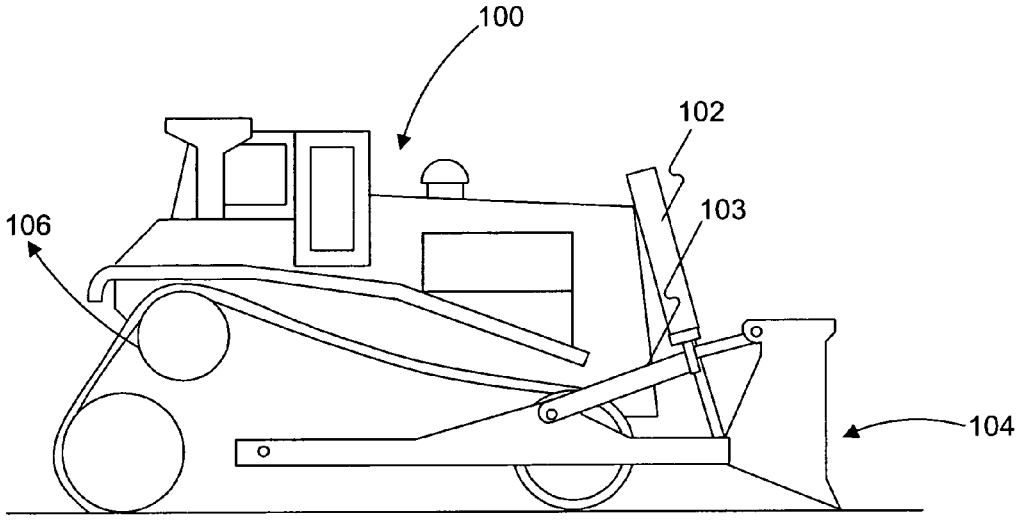
FIG. 1A illustrates an earthmoving machine in which embodiments of the present system may be implemented.

FIG. 1A illustrates a tractor 100 including a hydraulic mechanism 102, which may include a lift cylinder, a hydraulic mechanism 103, an implement 104, such as a blade, and sprocket 106.

An operator of tractor 100 may perform work, such as excavating material from or covering material on a worksite. The operator may cause hydraulic mechanisms 102 and 103 to direct a motion of implement 104, through a lever (not shown). For example, hydraulic mechanism 102 may be a lift actuator that lifts implement 104 to and from an up position and a down position. Hydraulic mechanism 103 may be a tilt actuator that tilts implement 104 to and from a forward position and a backward position. Hydraulic mechanisms 102 and 103 may receive electrical signals from internal devices within tractor 100 for controlling movement of hydraulic mechanisms 102 and 103. For example, electrical signal may be applied to hydraulic mechanism 102 to move implement 104 in an up position or a down position, while other electrical signals applied to hydraulic mechanism 103 move implement 104 backward and forward. The electrical signals may be control signals (e.g., CELC) from a proportional-plus-derivative controller that may be dependent upon a proportional control gain ($K_p$) and a derivative control gain ($K_d$), as noted above and discussed in further detail below.

Figure 2A:
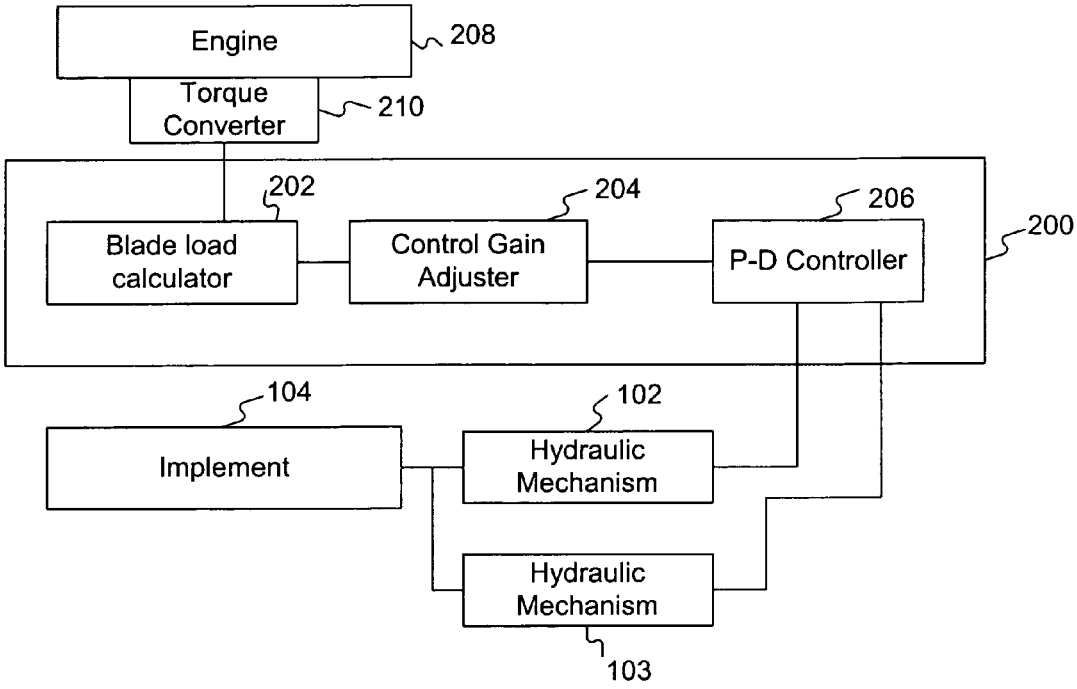
FIG. 2A illustrates a block diagram having a control system consistent with one exemplary embodiment.

FIG. 2A illustrates a control system 200 for controlling hydraulic mechanisms 102 and 103 consistent with one exemplary disclosed embodiment. Control system 200 includes blade load calculator 202, control gain adjuster 204, and a proportional plus derivative (PD) controller 206. Also illustrated in FIG. 2 is an engine 208, a torque converter 210, hydraulic mechanisms 102 and 103, and implement 104. Control system 200 may be configured to be electrically coupled to hydraulic mechanisms 102 and 103, through controller 206. As discussed with respect to FIG. 1A, hydraulic mechanisms 102 and 103 may direct the movement of implement 106 in accordance with electrical signals received from proportional plus derivative controller 206.

Generally, blade load calculator 202 (or load calculator) determines an estimated blade load associated with implement 104. As discussed in greater detail below with respect to FIGS. 3-6, blade load calculator 202 may estimate the blade load from measurements obtained from engine 208. Based upon the estimated blade load, control gain adjuster 204 may adjust control gains (e.g., a proportional control gain and a derivative control gain) associated with controller 206. Controller 206 sends a control effect lift command (CELC), or other appropriate electrical signals to hydraulic mechanisms 102 and 103 in accordance with the adjusted control gains such as the proportion and derivative gains noted previously. The hydraulic mechanisms 102 and 103 may direct a motion of implement 104 depending upon the CELC and the associated control gains. For example, if the control gains were set for a light material (e.g., loose rock) and the operator attempted to move a heavier material (e.g., wet clay), control system 200 would further change the control gains so that implement 104 has sufficient response to move the heavier material in a controlled manner.

In addition, the control effort lift command may be dependent upon not only the estimated blade load, but also the machine speed. In this case, the machine speed may be determined, for example, from an engine speed signal associated with engine 208. The machine speed may also be determined by other methods such as using power train speed or hydraulic sensors, ground speed radar, ultrasonics, desired gear ratios or other control parameters. The machine speed may be determined by any acceptable method known in the art.

Control system 200 may be a microprocessor element, with associated memory and program instructions, to perform the functions as explained above. Control system 200 may be implemented as an electronic circuit component to perform the functions of blade load calculator 202, control gain adjuster 204, and controller 206.

Figure 2B:
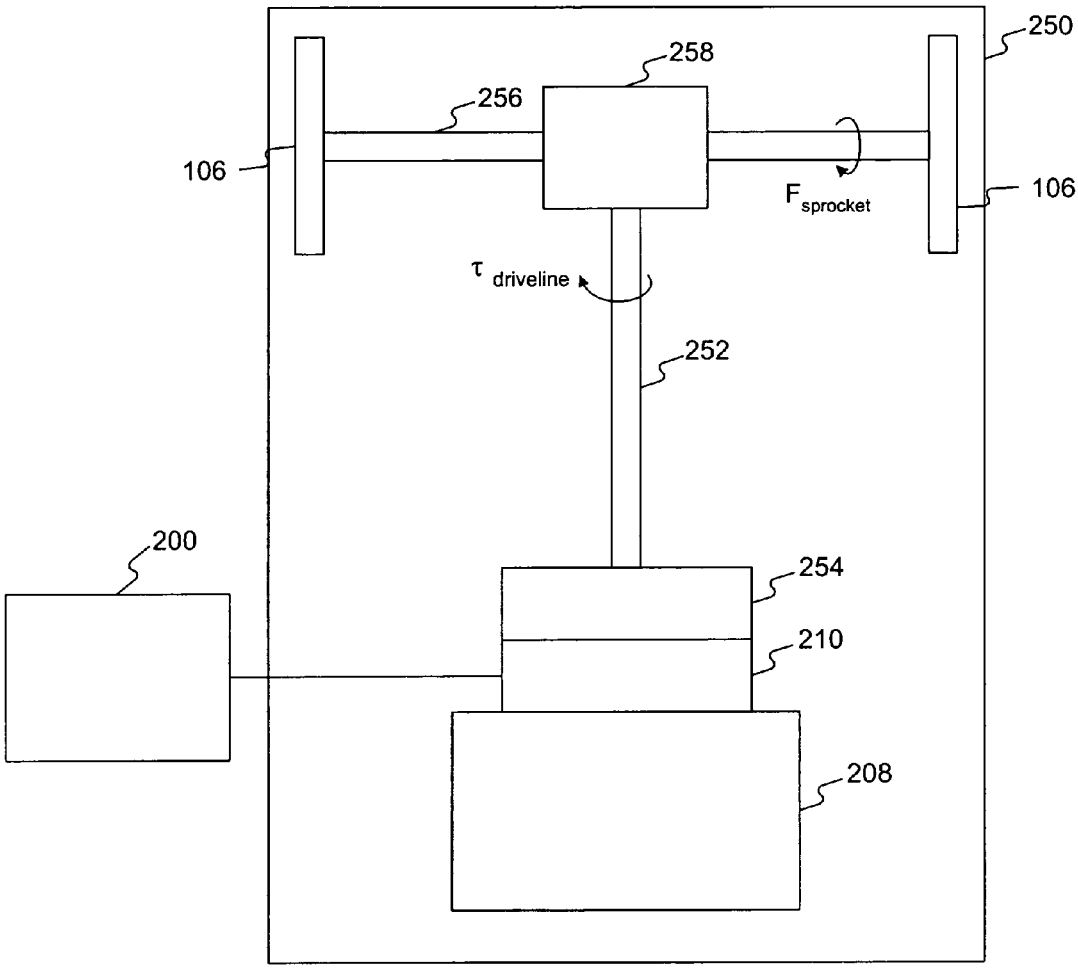
FIG. 2B illustrates a block diagram of drivetrain of an earthmoving machine.

FIG. 2B shows a block diagram of a system 250 in a machine 100 that may be coupled to control system 200. System 250 includes a driveshaft 252, a transmission 254, an axle 256, a torque transmitting element 258, sprockets 106, engine 208, and torque converter 210.

As engine 208 runs, torque converter 210 transfers energy generated by engine 208 to transmission 254. Transmission 254 rotates driveshaft 252 to produce a driveline torque ($\tau_{driveline}$). The driveline torque is transferred to axles 256 and sprockets 106 by torque transmitting element 258, which may further include a gear (not shown) coupled to axle 256 to engage driveshaft 252. The gear has an associated gearing constant, which is multiplied by the driveline torque to yield the sprocket force ($F_{sprocket}$). As system 250 operates, the applied sprocket force causes tracks of machine 100 to move, thereby moving machine 100 in a direction consistent with an operator's command. Control system 200 receives information from system 250 in order to make calculations regarding the blade load, as explained in further detail below.

INDUSTRIAL APPLICABILITY

In accordance with an aspect of the present disclosure a method for automatically adjusting the control gains will next be described in connection with flowchart 300 shown in FIG. 3.

Method 300 begins at stage 302 in which an estimated blade load associated with the earthmoving implement (e.g., a tractor blade) is determined.

The estimation of the blade load is determined through measurement of torque, as explained in further detail below with regard to FIG. 4.

At stage 304, control gains are adjusted according to the estimated blade load or combination of blade load and travel speed of machine 100.

At stage 306, the implement (e.g., blade) may be directed to a position based upon the adjusted control gains. In particular, the control gains are applied to hydraulic mechanisms 102 and 103 as an appropriate CELC. The CELC may be a function of the blade load (CELC(bl)) or may be a function of blade load and travel speed of the tractor (CELC(bl,speed)). Determination of the appropriate CELC is explained in further detail below.

Figure 3:
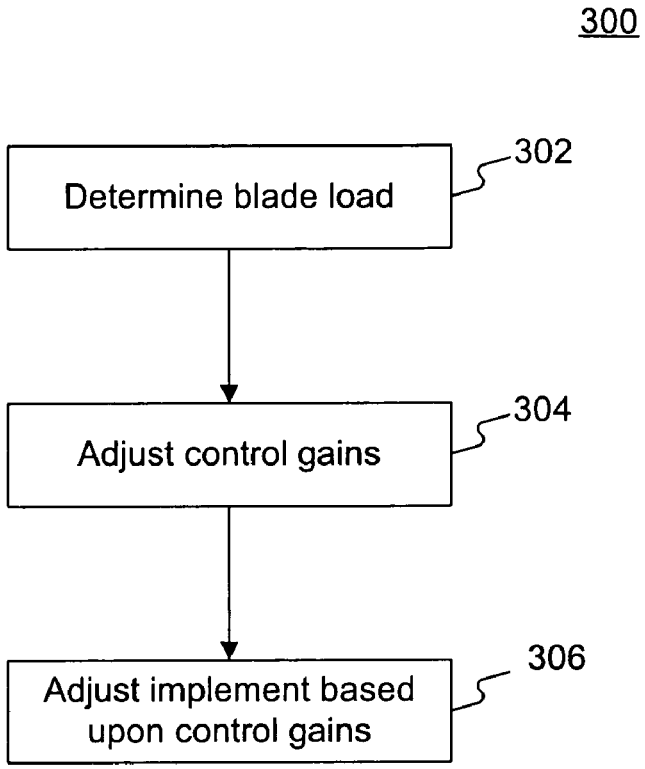
FIG. 3 is a flowchart illustrating a method for automatically adjusting a control gain associated with an earthmoving implement consistent with one exemplary embodiment.
Figure 4:
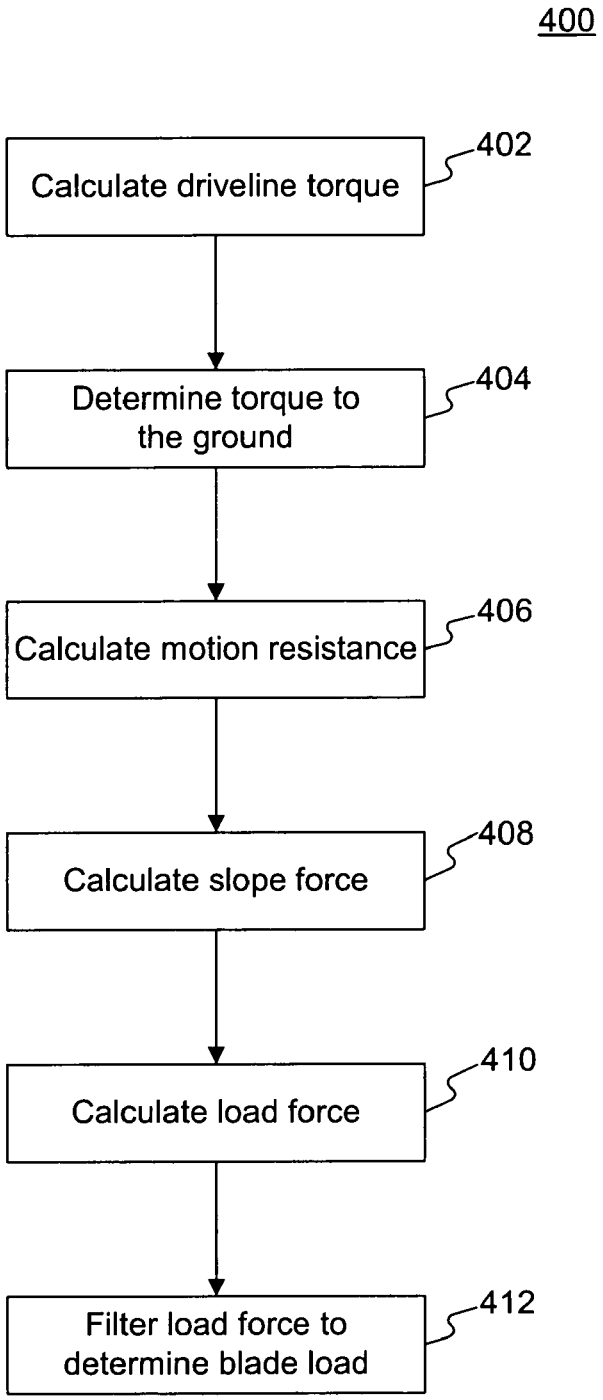
FIG. 4 is a flowchart illustrating a method for determining a blade load consistent with one exemplary embodiment of the present invention.

FIG. 4 further illustrates a flowchart for a method 400 for determining an estimated blade load (stage 302 of FIG. 3). The bladeload is estimated by measuring or calculating other parameters such as the driveline torque, a torque associated with the ground, a load force, and the sprocket force. The torque associated with the ground is further determined by calculating forces attributable to motion resistance of the machine and a slope of the ground. These calculations are discussed in further detail below.

Method 400 begins at stage 402 in which blade load calculator 202 calculates a force applied to components, which collectively transmit power from the transmission of a running engine to the drive axles. Such force, or driveline torque, may be supplied to sprocket 106, which is coupled to the track that directs movement of the tractor. As noted above, the sprocket, in turn, rotates the machine tracks, with a corresponding sprocket force ($F_{sprocket}$).

The driveline torque required to achieve any given speed of the earthmoving machine typically depends upon a number of factors, such as, a weight of the earthmoving machine, whether the machine is on a slope, material on the blade, and ground conditions, such as whether the machine is operating in wet or muddy ground. For example, if the tractor is relatively heavy, a high driveline torque may be required to turn the tractor tracks. Further, if the tractor is on a slope, more driveline torque may be needed to move the tractor up the slope, as opposed to moving the tractor along flat land. Material on the blade may also cause the tractor to weigh more than not having any weight on the blade, thereby further requiring more driveline torque. Also, wet or muddy ground may create a greater motion resistance requiring more driveline torque to move the tractor, compared to when the tractor is on dry or solid ground.

Driveline torque can be calculated by one or more operating conditions of the torque converter, for example, based on the output speed of a torque converter. A torque converter is a known fluid coupling and is a device used with automatic transmissions. The torque converter is coupled between an engine and a transmission in order to ensure that the engine may continue to run independently from the transmission when the machine slows down, such as for example when brakes are applied to stop the machine. The input speed of the torque converter is the engine speed and the output speed of the torque converter determines the driveline torque. For example, speed ratios of the torque converter, calculated from a ratio of the input speed and the output speed, can be used to determine a torque ratio of the torque converter. The torque ratio can be used with an engine toque (known, for example, from an engine torque curve) to calculate the driveline torque. This could be calculated continuously or implemented in software in a form of look-up maps.

Alternatively, the driveline torque, $\tau_{driveline}$, may be calculated based on an estimate of the engine torque, $\tau_{engine}$, which is related to fuel consumption rate of the engine and engine speed. In particular, driveline torque may be calculated as:

$$\tau_{driveline}=\tau_{engine}-\text{Estimated Parasitic Losses.}$$

Estimated parasitic losses may be losses in engine output based upon factors such as friction of engine parts and are determined in a known manner. The engine torque may be a force generated by the engine upon wheels and gears of a transmission, and the output force from the transmission translates into driveline torque, which in turn is supplied to the sprockets as noted above. Parasitic losses may cause the driveline torque to be lower than the torque generated by the engine by dampening the power associated with the engine.

Consistent with a further aspect of the present disclosure, driveline torque may be calculated on so-called hydrostatic machines, which have a hydrostatic transmission. A hydrostatic transmission includes a variable-displacement pump and a fixed or variable displacement motor, operating together in a closed circuit. In the closed circuit, fluid from the motor outlet flows directly to the pump inlet, without returning to the tank. In order to calculate a driveline torque of a hydrostatic machine, a pressure drop across the motor may be measured and multiplied by a motor displacement value. The motor displacement value may be measured or estimated based on a desired displacement.

Consistent with a further aspect of the present disclosure, driveline torque may be calculated on electric drive machines. Electric drive machines use an electric generator coupled to the engine to generate power which can be used by electric drive motors coupled to track sprockets. In order the calculate a driveline torque of an electric drive machine, driveline torque may be determined from a map relating motor torque to a measured electric drive motor speed. The torque map may also vary as a function of the measured electric drive motor speed and a voltage across the electric drive motor, thus, the driveline torque may also be determined as a function of the electric motor speed and the voltage across the electric drive motor.

While various methods of calculating or determining a driveline torque for a machine are presented above, one of ordinary skill in the art will appreciate that other additional methods of determining or calculating the driveline torque may be employed consistent with the present disclosure.

Returning to FIG. 4, at stage 404, a torque associated with the ground is determined, which is typically the sum of the motion resistance and the slope force. The motion resistance is defined as the force acting against the machine from ground conditions that hinder machine movement, and the slope force is the force needed to move a machine up a slope. Motion resistance and the slope force are discussed in greater detail below.

At stage 406, motion resistance is calculated. The motion resistance may be low if the ground is dry and solid, but may be high if the tracks of the tractor do not adequately engage with the ground to move the machine. For example, wet or muddy ground may require more force to move the machine as opposed to dry ground with a high coefficient of friction. Motion resistance may be expressed by the following equation:

$$F_{Motion\ Resistance}=\text{machine weight*effective rolling resistance+track speed*effective track resistance.}$$

The effective rolling resistance and effective track resistance are forces acting against the machine as an operator drives the machine. The track speed is the speed at which the tracks of the machine move.

At stage 408, the slope force is calculated. Slope force is substantially equal to the additional driveline torque required to move a machine up a slope compared to level ground. Slope force may be expressed by the following equation:

$$F_{slope}=\text{machine weight*sin(slope angle).}$$

The automatic control system may also include a slope detector (e.g., provided as part of blade load calculator 202) for determining the slope or inclination upon which machine 100 is operating. The slope detector may be a sensor that produces a slope signal. In one embodiment, the slope detector may include an angular rate sensor such as a conventional gyroscope in conjunction with a known Kalman filter. The slope detector may also be a known sensor that uses capacitive or resistive fluids.

The slope angle may be an angle of incline of a hill upon which machine 100 operates. When the angle is zero (i.e., no slope), sin(0) is equal to zero and thus, the slope force is zero. Accordingly, in this instance, no additional driveline torque is necessary to move the machine.

Thus, the torque associated with the ground, or in other words, the total force acting upon the machine to hinder its progress, may be calculated as:

$$\tau_{ground}=F_{motion\ resistance}+F_{slope}$$

At stage 410 a load force may be calculated. The load force is a force required to move a load on implement 104, absent the forces attributable to ground (i.e., forces caused by the motion resistance and the slope are subtracted so that a force attributed load can be singled out). The load force ($F_{load}$) may be expressed as:

$$F_{load}=F_{sprocket}-F_{motion\ resistance}-F_{slope}$$

$F_{sprocket}$ in the above equation is the sprocket force, which is a force generated by sprockets in order to rotate the track of the machine and is based upon the driveline torque. As noted above, the driveline torque may be multiplied by a gearing constant associated with a gear in torque transmitting element 258 which the machine is operating to yield the sprocket force in accordance with the following formula:

$$F_{sprocket}=\tau_{driveline}\text{*Gearing Constant}$$

At stage 412, the mathematical value of load force is filtered to determine an estimate blade load. Filtering may be performed using known methods in the art. Filtering the load force eliminates sudden forces applied to the blade that may occur when the tractor encounters an unexpected force. As a result, spikes in the load force are not factored into the calculation of control gains. Accordingly, stable CELC signals are applied to hydraulic mechanisms 102 and 103 controlling implement 104.

For example, while smoothing or covering a worksite, a blade of a machine may encounter a hard spot (e.g., a rock protruding from the ground surface), whereby the blade load will increase suddenly upon engaging the hard spot. The sudden increase in blade load is filtered so that the control gains do not increase suddenly and cause the hydraulic mechanisms to direct the blade to dig deeper. By filtering anomalies such as these, unnecessary adjustment of the control gains may be eliminated.

Thus, the estimated blade load may be determined by the following equation:

$$\text{Est. Blade Load}=0.9\,F_{load}(z)-0.1\,F_{load}(z)$$

where $z=e^{-nT}$ and T=0.02 sec.

The estimated blade load may also be expressed as:

$$\text{Est. Blade Load}=k(0.9\,F_{load}(T)-0.1\,(F_{load}(T-0.02))$$

where k is a known constant.

Figure 1B:
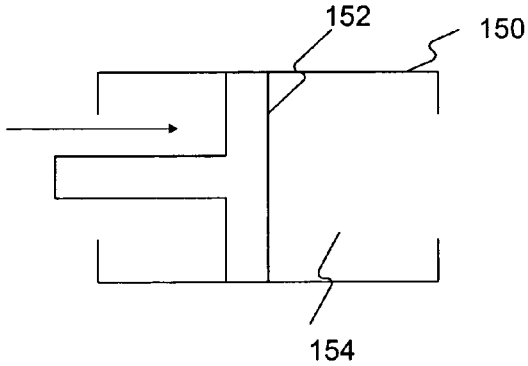
FIG. 1B illustrates a hydraulic cylinder.

Alternatively, the blade load may be calculated based on a blade lift force, which is typically a force required to lift the blade of the machine. If the machine has a single hydraulic mechanism, e.g., mechanism 102 shown in FIG. 1A, with only one cylinder, the blade lift force is equal to the area of the cylinder multiplied by the pressure associated with the cylinder during lifting. For example, FIG. 1B shows cylinder 150, associated with hydraulic mechanism 102, piston 152, and region 154. A force is applied to piston 152 (as shown by the arrow). Fluid in region 154 is subject to a lift cylinder pressure based upon the applied force and the area of piston 152. The applied force may be the blade lift force and may be used to determine the blade load. If multiple lift mechanisms are provided, a pressure-cylinder area product of each is determined and then summed to obtain an aggregate blade lift force.

When the implement is not accelerating (i.e., zero or constant velocity), the blade load is determined by subtracting the blade mass (which is the weight of the blade when empty) from the blade lift force.

During acceleration, however, forces attributable to the acceleration (or deceleration) of the implement moving in a linear direction and forces attributable to gravity (1G=9.81 $m/s^2$) act upon the blade load. Thus, under these circumstances, the blade load may be represented by the following equation:

$$\text{Blade Load*(1G-Vertical Acceleration)=Cylinder Pressure*Effective Area-Blade Mass (1G-Vertical Acceleration).}$$

Returning to FIG. 3, using the blade load calculation from any of the methods described above, the control gains are adjusted (stage 304 of FIG. 3), for example, by control gain adjuster 204. In particular, the control gains may be adjusted, for example, to compensate for an increase in the load of the blade. Because the control gains are configured to one type of material, an increase in blade load may require an increase in the control gains to adequately control the increase blade load. In cases where machines such as track type tractors are used, there may be a linear relationship between the control gain and the change in blade load.

Control gain adjustment based on blade load will next be described in greater detail.

As noted above, the proportional-plus-derivative controller supplies control signal CELC. CELC is a linear combination of an error signal and a derivative of the error signal. The error signal may represent the difference between a target position of the blade and an actual position of the blade. The proportional-plus-derivative controller may contain a proportional control gain ($K_p$) and a derivative control gain ($K_d$).

The control gains are applied to the error signal in order to eliminate the error and stabilize the blade to a desired position. The proportional control gain corrects the error signal in a linear fashion, by correcting the error in an amount proportional to the amount of error. Thus, as the error signal increases in value, so does the proportional gain factor and vice versa. The derivative gain factor stabilizes the error signal to avoid oscillation, thereby reducing overshoot.

Using the estimated blade load from stage 412 of FIG. 4, the proportional gain ($K_p$) as a function the blade load (bl) may be adjusted by control gain adjuster 204 according to the following formula:

$$K_p(bl)=K_{p\text{-}nom}(bl)+K_{p_gain_adj_factor}(bl)*(\text{Estimated Blade Load}-\text{Nominal Blade Load}) \quad \text{(Equation 1)}$$

where:

$K_p$(bl)=the proportional control gain;

$K_{p\text{-}nom}$(bl)=a nominal proportional control gain;

$K_{p_gain_adj_factor}$(bl)=a proportional control gain adjustment factor;

Estimated Blade Load=The estimated blade load as calculated above; and

Nominal Blade Load=a nominal force on the blade.

If $K_p$(bl)>a maximum allowed proportional gain ($K_p(bl)_{max}$), $K_p$(bl) is limited to $K_p(bl)_{max}$.

Also, using the estimated blade load as determined in stage 412 of FIG. 4, the derivative gain ($K_d$) as a function the blade load (bl) may be adjusted by control gain adjuster 204 according to the following formula:

$$K_d(bl)=K_{d\text{-}nom}(bl)+K_{d_gain_adj_factor}(bl)*(\text{Est. Blade Load}-\text{Nominal Load}) \quad \text{Equation (2)}$$

where:

$K_d$(bl)=the derivative control gain;

$K_{d\text{-}nom}$(bl)=a nominal derivative control gain;

$K_{d_gain_adj_factor}$(bl)=a derivative control gain adjustment factor;

Estimated Blade Load=the estimated blade load as calculated above; and

Nominal Blade Load=a nominal load on the blade.

If $K_d$(bl)>a maximum allowed proportional gain ($K_d(bl)_{max}$), $K_d$(bl) is limited to $K_d(bl)_{max}$.

The proportional gain adjustment factor ($K_{p_gain_adj_factor}$(bl)) and derivative gain adjustment factor ($K_{d_gain_adj_factor}$(bl)) may be determined by a technician or set from a factory and provides a linear adjustment to the nominal proportional gain and the nominal derivative gain based upon the blade load. As an alternative, $K_{p_gain_adj_factor}$(bl) and $K_{d_gain_adj_factor}$(bl) may be determined from a lookup table of blade loads (or material weight) and corresponding proportional and derivative gain values. The gain adjustment factors ($K_{p_gain_adj_factor}$ and $K_{d_gain_adj_factor}$) are explained in further detail below.

Figure 5:
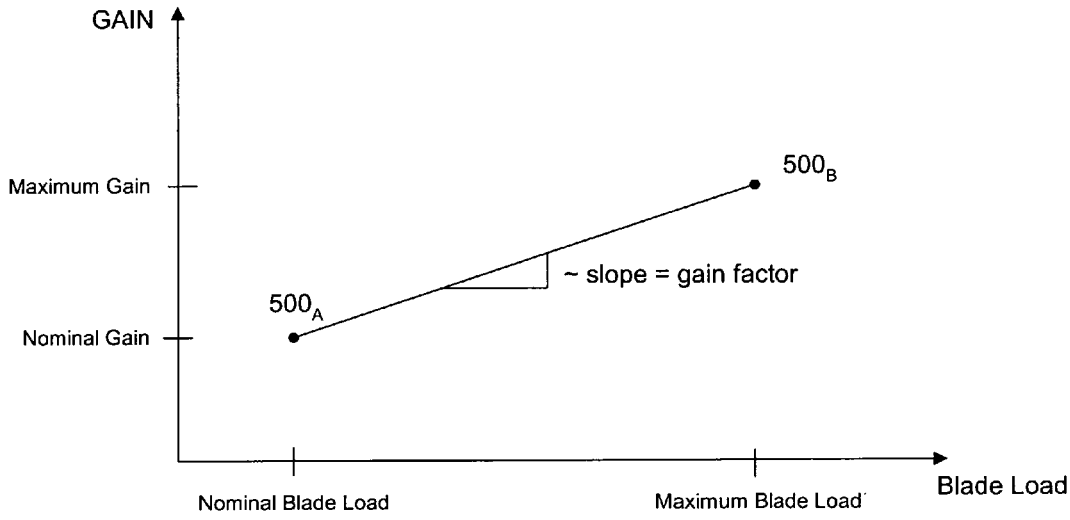
FIG. 5 is a graph showing a relationship between gain and blade load.

FIG. 5 illustrates a generic relationship between a control gain (proportional and/or derivative) and blade load to calculate the gain adjustment factor. The relationship is the same for either the proportional control gain or the derivative control gain. As noted above, there may be a linear relationship between the control gains and blade load, as shown in line $\mathbf{500}_A$-$\mathbf{500}_B$. The slope of line $\mathbf{500}_A$-$\mathbf{500}_B$ may be the control gain adjustment factor associated with either the proportional and derivative control gains. The maximum blade load may be an upper limit or tolerance of the blade load (e.g., a maximum of weight a blade may carry). The nominal blade load may be an empty blade.

Figure 6:
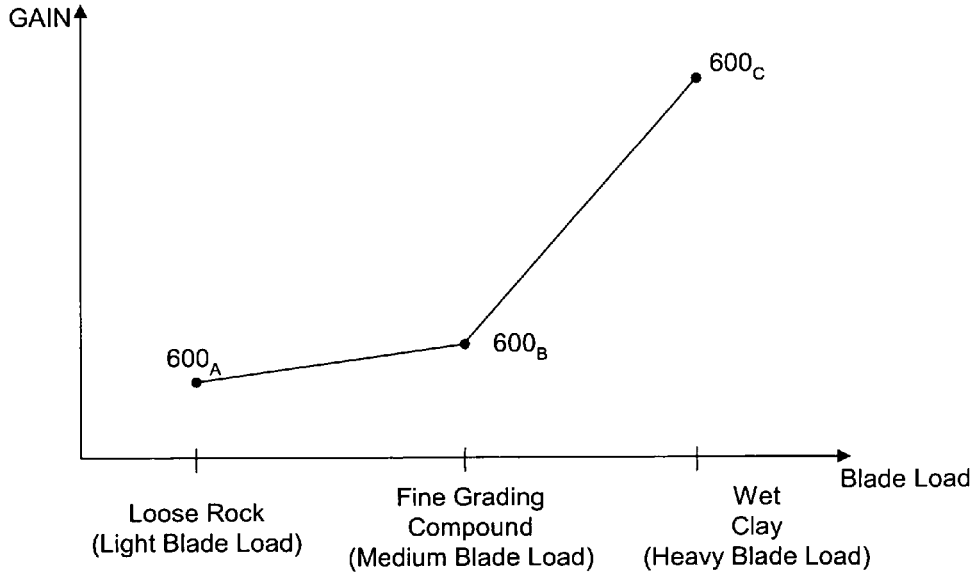
FIG. 6 is a graph showing a relationship between gain and different materials on a blade load.

The slope of line $\mathbf{500}_A$-$\mathbf{500}_B$ may also be empirically derived from the type of material being manipulated by an earthmoving machine. For example, FIG. 6 shows a relationship between the control gain (either proportional control gain or derivative control gain) and three different material types. Loose rock may have a light blade load compared to other types of materials and have a gain shown at point $\mathbf{600}_A$. A fine grading compound may have a gain at point $\mathbf{600}_B$, while a relatively heavy material (such as wet clay) may have a gain at point $\mathbf{600}_C$.

The slope of the line as shown in FIG. 6, which is a function of the control gain and blade load, is used as the gain adjustment factors ($K_{p_gain_adj_factor}$ and $K_{d_gain_adj_factor}$).

Using $K_p$ and $K_d$ as determined in equations 1 and 2 above, CELC(bl) is determined. As noted previously, CELC(bl) may be the signal supplied to hydraulic mechanisms 102 and 103 by controller 206, and may be expressed as:

$$CELC(bl)=K_p(bl)*e_{bh}+K_d(bl)*d(e_{bh})/dt$$

where:

CELC(bl)=control effort lift command as a function of blade load;

$K_p$(bl)=the proportional gain as a function of blade load;

$e_{bh}$=an error in blade height (e.g., the difference in target position of the blade from an actual position of the blade); and $K_d$(bl)=the derivative control gain as a function of blade load;

and $d(e_{bh})/dt$=an instantaneous rate of change of the error in blade height as a function of time.

The control effort lift command as a function of blade load (CELC(bl)) is a control signal that is a linear combination of an error signal multiplied by the proportional gain, $K_p(bl)*e_{bh}$, plus the derivative of the error signal multiplied by the derivative gain, $K_d(bl)*d(e_{bh})/dt$.

In addition, the proportional and derivative control gains may be adjusted as a function of blade load and machine travel speed. Where $K_p$ and $K_d$ as a function of travel speed may be represented as:

$$K_p(\text{speed})=K_{p\text{-}nom}(\text{speed})+K_{p_gain_adj_factor}(\text{speed})*(\text{Machine speed}); \text{ and}$$

$$K_d(\text{speed})=K_{d\text{-}nom}(\text{speed})+K_{d_gain_adj_factor}(\text{speed})*(\text{Machine speed}).$$

The proportional gain adjustment factor ($K_{p_gain_adj_factor}$(speed)) and derivative gain adjustment factor ($K_{d_gain_adj_factor}$(speed)) may be determined by a technician or set from a factory and provides a linear adjustment to the nominal proportional gain and the nominal derivative gain based upon the machine travel speed. As an alternative, $K_{p_gain_adj_factor}$(bl) and $K_{d_gain_adj_factor}$(bl) may be determined from the use of a lookup table showing a relationship between the machine travel speeds and the proportional and derivative gains.

The control effort lift command as a function of blade load and travel speed (CELC(speed)) may be represented as:

CELC(bl, speed)=Kp(bl, speed)$e_{bh}$+Kd(bl, speed)*$d(e_{bh})$/dt where

CELC(bl, speed)=control effort lift command as a function of blade load and travel speed;

$K_p$(bl, speed)=the proportional gain as a function of blade load and travel speed;

$e_{bh}$=an error in blade height (e.g., the difference in target height from an actual height); and $K_d$(speed)=the differential gain as a function of blade load and travel speed; and $d(e_{bh})/dt$=an instantaneous rate of change of the error in blade height as a function of time.

In order to determine Kp(bl, speed) and Kd(bl, speed), Kp(bl) is multiplied by Kp(speed), which equals Kp(bl, speed) and Kd(bl) is multiplied by Kd(speed), which equals Kd(bl, speed). Accordingly, adjusting the control gains may be achieved using both blade load and travel speed as indicators for accurate control gain adjustment.

The present disclosure may be implemented by one or more microprocessors resident in machine 102 that may carry out the functions as described in connection with methods described with regard to FIGS. 3 and 4.

The present disclosure is advantageously used in construction equipment such as wheel and track type tractors for automatic grade control or automatic laser leveling systems. It can be appreciated that by using the principles disclosed herein, a tractor may adjust control gains based upon a blade load and/or machine speed.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A method of adjusting an implement comprising:

receiving an input indicative of a desired implement movement;

moving the implement based on the input;

determining a load associated with the implement; and based on the load, automatically adjusting an electronic control gain associated with movement of the implement based upon the input.

2. The method of claim 1, wherein the load is determined by calculating a force associated with the load.

3. The method of claim 2, wherein the force associated with the load is dependent upon a driveline torque.

4. The method of claim 3, wherein the force associated with the load is dependent upon a sprocket force, the method further including multiplying the driveline torque with a gearing constant to determine the sprocket force.

5. The method of claim 4, wherein the force associated with the load is further dependent upon a torque associated with a ground surface.

6. The method of claim 5, wherein the torque associated with the ground surface is dependent upon a force associated with a motion resistance and a force associated with a slope of the ground surface.

7. The method of claim 6, wherein the force is filtered to determine the load.

8. The method of claim 7, wherein adjusting the electronic control gain includes adjusting a proportional control gain as a function of a proportional control gain adjustment factor and a derivative control gain as a function of a derivative control gain adjustment factor.

9. The method of claim 7, wherein adjusting the control gains includes adjusting a proportional control gain as a function of a proportional control gain adjustment factor.

10. The method of claim 1, wherein the load is determined as a function of a lift cylinder pressure.

11. The method of claim 10, wherein adjusting the electronic control gain includes adjusting a proportional control gain as a function of a proportional control gain adjustment factor and a derivative control gain as a function of a derivative control gain adjustment factor.

12. The method of claim 10, wherein adjusting the control gain includes adjusting a proportional control gain as a function of a proportional control gain adjustment factor.

13. A system for controlling an implement, comprising:

an input device configured to receive input indicative of a desired movement of the implement;

a load calculator configured to determine a load; and a controller being configured move the implement based on the input and to electronically adjust a control relationship between the input and the movement based upon the load.

14. The system of claim 13, wherein the load calculator is configured to determine the load as a function of a force associated with the load.

15. The system of claim 14, wherein the load calculator is configured to determine the force associated with the load as a function of at least one of driveline torque, speed, speed ratio, and desired gear ratio.

16. The system of claim 15, wherein the load calculator is configured to determine the force associated with the load as a function of a sprocket force, the sprocket force being determined based on a product of the driveline torque and a gearing constant.

17. The system of claim 16, wherein the load calculator is configured to determine the force associated with the load as a function of a torque associated with a ground surface.

18. The system of claim 17, wherein the load calculator is configured to determine the torque associated with the ground surface as a function of a force associated with a motion resistance and a force associated with a slope.

19. The system of claim 18, wherein the controller is configured to adjust the control relationship by adjusting a proportional control gain as a function of a proportional control gain adjustment factor and a derivative control gain as a function of a derivative control gain adjustment factor.

20. The system of claim 13, wherein the load calculator is configured to determine the load as a function of a lift cylinder pressure.

21. The system of claim 20, wherein the controller adjusts the control relationship by adjusting a proportional control gain as a function of a proportional control gain adjustment factor and a derivative control gain as a function of a derivative control gain adjustment factor.

22. A method of adjusting an electronic control gain of a work implement, the method comprising:

receiving an input indicative of a desired work implement movement;

moving the work implement based on the input;

calculating a load associated with the work implement as a function of a driveline torque; and adjusting the electronic control gain of the work implement as a function of the calculated load on the work implement to affect movement of the work implement based on the input.

23. The method of claim 22, wherein calculating the load on the work implement includes:

calculating a torque to a ground surface; and calculating the load as a function of the driveline torque and the torque to the ground.

24. The method of claim 23, wherein calculating a torque to the ground further includes:

calculating a motion resistance of the machine; and calculating a slope force of the machine.

25. The method of claim 23, further including filtering the load.

26. The method of claim 23, wherein the driveline torque is determined by one or more operating conditions of the torque converter.

27. The method of claim 23, wherein the driveline torque is proportional to an output force of the converter.

28. The method of claim 23, wherein the driveline torque is determined from an estimate of an engine torque from an engine.

29. The method of claim 28, wherein the engine torque is estimated based on a fuel consumption rate by the engine and a speed of the engine.

30. The method of claim 28, wherein the driveline torque is equal to the engine torque less an estimate of parasitic losses attributable to the engine.

31. The method of claim 22, wherein the driveline torque is determined by multiplying a pressure drop across a motor by a motor displacement value.

32. The method of claim 22, wherein the driveline torque is determined as a function of an electric drive motor speed associated with an electric drive motor.

33. The method of claim 22, wherein the driveline torque is determined as a function of an electric drive motor speed associated with an electric drive motor and a voltage across the electric drive motor.

34. The method of claim 22, wherein adjusting the electronic control gain further includes adjusting the proportional gain.

35. The method of claim 22, wherein adjusting the electronic control gain further includes adjusting the derivative gain.

36. The method of claim 22, wherein the electronic control gain is a function of a gain adjustment factor.

37. The method of claim 23, wherein adjusting further includes multiplying the gain adjustment factor by the load and adding a nominal proportional gain.

38. The method of claim 22, wherein the electronic control gain is a linear function of the load.

39. A method of adjusting an electronic control gain of a work implement, comprising:

receiving an input indicative of a desired work implement movement;

moving the work implement based on the input;

calculating a load on the work implement as a function of a lift cylinder pressure of the work implement; and adjusting the electronic control gain of the work implement as a function of the calculated load to affect movement of the work implement based on the input.

40. The method of claim 39, wherein calculating the load includes, during a period of relatively constant velocity of the work implement, calculating the load as a function of the lift cylinder pressure and an effective area of the lift cylinder, and weight of the work implement.

41. The method of claim 39, wherein calculating the load includes, during a period of acceleration or deceleration of the work implement, calculating the load as a function of the lift cylinder pressure, an effective area of the lift cylinder, a weight of the work implement, and a linear acceleration of the work implement.

42. The method of claim 39, wherein adjusting the electronic control gain further includes adjusting the proportional gain.

43. The method of claim 39, wherein adjusting the electronic control gain further includes adjusting the derivative gain.

44. The method of claim 39, wherein the electronic control gain is a function of a gain adjustment factor.

45. The method of claim 44, wherein adjusting further includes multiplying the gain adjustment factor by the load and adding a nominal proportional gain.

46. The method of claim 39, wherein the electronic control gain is a linear function of the load.

47. A method of adjusting an electronic control gain of a work implement on a machine, comprising:

receiving an input indicative of a desired work implement movement;

moving the work implement based on the input;

calculating a load associated with the work implement;

calculating a speed of the machine; and adjusting the electronic control gain of the work implement in accordance with a function of the load and machine speed to affect movement of the work implement based on the input.

* * * * *